United States Patent [19]

Currier et al.

[11] Patent Number: 4,502,842

[45] Date of Patent: Mar. 5, 1985

[54] MULTIPLE COMPRESSOR CONTROLLER AND METHOD

[75] Inventors: Stephen M. Currier; Bert G. H. Penhollow, both of Quincy; Gordon G. Hof, Mendon; Norbert L. Mast, Quincy, all of Ill.

[73] Assignee: Colt Industries Operating Corp., New York, N.Y.

[21] Appl. No.: 463,126

[22] Filed: Feb. 2, 1983

[51] Int. Cl.[3] ..... F04B 41/06

[52] U.S. Cl. ..... 417/8; 364/510; 364/558; 417/53; 417/63

[58] Field of Search ..... 417/2–8, 417/53, 63; 364/509, 510, 558; 73/199, 712; 60/368

[56] References Cited

U.S. PATENT DOCUMENTS

| | | | |
|---|---|---|---|
| 2,812,110 | 11/1957 | Romanowski . | |
| 3,160,101 | 12/1964 | Bartoseski et al. . | |
| 3,229,639 | 1/1966 | Highnutt et al. . | |
| 3,294,023 | 9/1966 | Martin-Vegue, Jr. et al. . | |
| 3,744,932 | 4/1971 | Prevett . | |
| 3,786,835 | 8/1972 | Finger . | |
| 3,792,317 | 11/1972 | Lafs . | |
| 4,120,033 | 10/1978 | Corso et al. . | |
| 4,152,902 | 5/1979 | Lush . | |
| 4,259,038 | 3/1981 | Jorgensen et al. | 417/53 |

*Primary Examiner*—Edward K. Look

*Attorney, Agent, or Firm*—Sixbey, Friedman & Leedom

[57] ABSTRACT

The multiple compressor controller and method accomplishes the control of a plurality of variable sized compressors in a multiple compressor distribution system to maintain system pressure at a desired level while maximizing compressor operating efficiency. Control data for use in determining system volume and leakage and various individual compressor parameters is obtained by using the system compressors in a calibration mode and monitoring the effect of each compressor on the system. Once such data is obtained and stored, a plurality of system operating pressures can be preset into a time clock controlled controller, and the controller will automatically maintain these pressures over the time periods indicated by efficiently selecting one or more compressors with the output capacity necessary to match any variation in system demand.

28 Claims, 9 Drawing Figures

MULTIPLE COMPRESSOR CONTROLLER AND METHOD

DESCRIPTION

1. Technical Field

This invention relates to a method and apparatus for controlling variously-sized compressors in a multiple compressor distribution system. Specifically, the invention relates to a method for multiple compressor or pump control wherein fluid input requirements are determined in response to variations in demand on the distribution system combined with the effect of system leakage, and selective units are thereafter loaded or unloaded in an optimum sequence calculated to meet the fluid input requirements while maximizing compressor operating efficiency. During certain intervals, the controller also provides for predetermined or fixed loading sequences in lieu of the selective or optimum loading sequence.

2. Background Art

In fluid distribution systems such as those designed to furnish compressed air to a variety of remote utilization sites in an industrial environment, the use of multiple fluid compressors to supply the distribution system with fluid under pressure is commonplace. The units are generally cycled on or off, i.e., loaded or unloaded, as a function of demand on the distribution system. For example, in an industrial-type compressed air supply system, the activation of one or more pneumatically driven machine tools connected to the system results in an outflow of compressed air and an attendant reduction in the overall system supply pressure. Obviously, if the system is to maintain sufficient capacity for supplying the remaining, unactivated pneumatic tools with operating air, one or more compressors must be loaded into the system to maintain the system pressure at an acceptable level. Likewise, if the shut-down of previously activated tools leaves the system with an over supply of compressed air, one or more loaded compressors must be unloaded in order to bring the system pressure back down to an acceptable level.

For any fluid distribution system, the question arises as to which pump or compressor unit ought to be loaded or unloaded, and in what order, in response to a given change in system demand. One criterion for answering this question simply involves the extent of the demand. A controller is wired to measure system pressure, and when that pressure drops below or climbs above a predetermined pressure set point, the controller respectively loads or unloads one of the available units. Continued pressure drop or rise after the respective loading or unloading of the first available unit causes the controller to load or unload the next available unit. This process is repeated as often as necessary, or until all of the units are either loaded or unloaded, in order to compensate for the change in system demand. Methods for implementing pump loading and unloading sequences of the foregoing type are disclosed in U.S. Pat. No. 2,812,110 issued to Romanowski on Nov. 5, 1957; U.S. Pat. No. 3,229,639 issued to Hignutt et al on Jan. 18, 1966 and U.S. Pat. No. 3,786,835 issued to Finger on Jan. 22, 1974.

Another criterion relevant to determining the order of pump or compressor unit loading and unloading involves wear. It may be desirable to more evenly apportion wear among a plurality of pumps, and for this reason rotational schemes which periodically shift the loading and unloading order of a plurality of units have been developed. Using a rotational scheme, a controller operator can insure that no one unit or small group of units is consistently loaded while other units continuously remain unloaded. U.S. Pat. No. 3,744,932 issued to Prevett on Apr. 30, 1971 and U.S. Pat. No. 3,792,317 issued to Laks on Dec. 18, 1972, disclose prior art methods of rotational sequencing of pump loading and unloading control in multi-pump systems.

A third criterion for multi-pump or compressor unit control seeks to optimize energy consumption in any given distribution network demand situation. Generally speaking, an individual fluid pump or compressor unit operates most efficiently when fully loaded. Where the output capacity of each unit in a multi-unit distribution system is the same, there is no opportunity for maximizing operating efficiency by matching a particular output to the particular demand requirements of the distribution system, because each pump is the same. It makes no difference from an operating efficiency standpoint whether one unit or another is loaded in response to demand variation. Where, however, the units in a multi-pump or compressor system vary with respect to output capacity, an appropriately designed controller can selectively load or unload individual units in a sequence which does maximize operating efficiency based on the distribution network demand situation of the moment. That is, with a multi-unit controller capable of determining optimum loading and unloading sequences, a unit having the proper output capacity can be fully loaded or completely unloaded to precisely meet the variation in demand on the distribution system. Several methods for maximizing pump operation have heretofore been developed, as disclosed by U.S. Pat. No. 3,160,101 issued to Bartoseski et al on Dec. 8, 1964; U.S. Pat. No. 3,294,023 issued to Martin-Vegue, Jr., et al on Sept. 27, 1966; U.S. Pat. No. 4,120,033 issued to Corso et al on Oct. 10, 1978 and U.S. Pat. No. 4,152,902 issued to Lush on May 8, 1979.

While all of the methods outlined above for loading and unloading fluid pumps, such as compressors, in a multi-unit fluid distribution system have met with success, the prior art has yet to effectively combine the ordered steps of each method in a practical, comprehensive manner suitable for programmed implementation by a single multi-pump controller. Moreover, the selective or optimization-type loading sequences of the prior art can only be carried out after complex computations have been performed and thus, the need exists for a method of multi-pump or compressor unit control wherein the loading and unloading of the units is governed by predetermined fixed loading sequences or selective optimized loading sequences dependent upon values automatically determined by the controller from measurements taken of the actual system controlled. An additional need exists for a method of multi-unit control wherein the selective unit loading sequences are chosen to maximize operating efficiencies on the basis of system parameters such as simple rate of distribution system pressure change, total distribution volume, rate of system leakage and relative unit output capacity.

DISCLOSURE OF THE INVENTION

It is therefore an object of the present invention to provide a method for multi-compressor or pump control in a fluid distribution system.

It is another object of the present invention to provide a method for multi-compressor control which loads and unloads the multiple compressor system units in accordance with the desired one of a plurality of compressor loading and unloading sequences.

It is still another object of the present invention to provide a method for loading and unloading a plurality of fluid distribution system compressors in a predetermined fixed loading sequence depending upon changes in the distribution system pressure.

It is an additional object of the present invention to provide a method for loading and unloading a plurality of fluid distribution system compressors wherein one compressor is of a lower capacity than the remaining compressors. To maximize compressor loading efficiency, the small compressor is loaded and unloaded between the loadings and unloadings of each of the larger compressors.

It is a further object of the present invention to provide a multi-compressor control method by which compressor operating efficiency may be maximized. Rate of pressure change in the fluid distribution system is measured and selected compressors are loaded or unloaded to compensate for the measured rate of pressure change in accordance with a selective loading sequence. The selective loading sequence is established by performing computations of the values representing the rate of pressure change, the total distribution system volume, the rate of distribution system leakage and the relative output capacity of each compressor. It is thus possible to accurately match the pressure requirements of the distribution system with the full load output of a particular compressor, and the overall operating efficiency of the system is in turn enhanced.

It is an object of the present invention to provide a multi-compressor control method for use in the control of a multi-compressor distribution system, which method includes the steps of performing a calibration function in order to determine the amount of distribution system leakage and the relative output capacity of each distribution system compressor.

It is also an object of the present invention to provide an apparatus and method for multi-compressor control which accomplishes the loading and unloading of distribution system compressors in accordance with either a predetermined set sequence control or a selective optimized loading sequence, in light of priorities which are assigned to the compressors controlled by each type of loading sequence. A system calendar may be employed to track the passage of time, and predetermined features of the set sequence control can be changed at discrete intervals programmed into the system calendar.

It is still another object of the present invention to provide an apparatus and method for multi-compressor control which accomplishes the loading and unloading of distribution system compressors in response to pressure indicating signals produced by a single pressure transducer mounted in the distribution system.

A further object of the present invention is to provide a novel and improved multiple compressor control system which operates in response to pressure indications provided from a fluid distribution system by a primary pressure transducer. This pressure transducer is incorporated in a system with a secondary pressure transducer and a three way solenoid valve which may be operated by a controller for the system to check the primary pressure transducer. When the solenoid valve is de-energized, the primary pressure transducer is vented to atmosphere, and the controller can check for pressure drop, rezero the transducer at 0 psig, and subsequently reconnect the transducer to the distribution system. If the primary transducer is not operating properly, the controller can actuate the solenoid valve so as to check and then insert the secondary pressure transducer into the system.

It is an object of the present invention to provide an apparatus and method for multi-compressor control which enables the loading and unloading of distribution system compressors in response to remote pressure measurements carried out at a plurality of remote sites located around the distribution system.

Another object of the present invention is to provide a novel and improved multiple compressor control method and apparatus for providing a calibration function wherein key value determinations are made by a controller and stored for use as subsequent control values for the controller. During the calibration function, the size or volume of the air system and the total system leakage are determined. Also the $\Delta_p/\Delta_t$ of each compressor is found as well as the Loaded Reaction time and Unloaded Reaction time for each compressor.

A further object of the present invention is to provide a novel and improved multiple compressor control method and apparatus for starting compressors in accordance with the total electrical power available so as not to disturb the total power distribution at a facility housing the compressors.

A further object of the present invention is to provide a novel and improved multiple compressor control method and apparatus wherein compressor control for a fluid distribution system is accomplished in response to a continuously updated pressure and $\Delta_p/\Delta_t$. Pressure measurements are continuously taken, and to accumulate a plurality of readings as a new reading is added to this group, the oldest reading is dropped from the group and a new average pressure value is calculated. This new average value is compared to the last average to calculate $\Delta_p/\Delta_t$.

A still further object of the present invention is to provide a novel and improved multiple compressor control method and apparatus for a multiple compressor system which provides a novel and improved control action based the $\Delta_p/\Delta_t$ of the system pressure and the measured reaction times of the compressors. Therefore given a preset boundary, the controller can judge when it will be necessary to load or unload a compressor or group of compressors in order to avoid crossing this boundary.

These and other objects of the present invention are accomplished by a method of multi-compressor control suitable for use with either an analog logic or microprocessor-based controller. The method concerns a means for implementing a predetermined fixed or a selective compressor optimization loading sequence. In the predetermined fixed loading sequence, a desired loading order for the distribution system compressors is programmed into the memory of a microprocessor based controller or the fixed loading sequence logic of an analog logic controller, while high and low pressure set points are also programmed into the memory for the controller. Distribution system pressure is then measured against the set points, and whenever the pressure drops below the programmed low pressure set point, the first compressor in the desired loading order is loaded into the distribution system to compensate for the change in pressure. After a short delay, the distribution system pressure is again measured, and if the measured value is still below the low pressure set point, the second compressor in the desired loading order is loaded. Delayed pressure measurements and compressor loading continue until the distribution system pressure climbs above the low pressure set point. Unloading of the compressors occurs in reverse order, i.e., the last loaded compressor is the first compressor to be unloaded and so on, under the direction of the fixed loading sequence whenever the distribution system pressure exceeds the high pressure set points.

A modification of this fixed loading sequence method may be accomplished in a multiple compressor system including a plurality of substantially equal sized compressors with a smaller trim compressor. As the system controller sequences the compressors in the system, it calls upon the trim or fill compressor in between the start or shutdown of each large compressor.

Operating energy consumption in a multi-compressor distribution system can be optimized by employing the selective loading sequence of the present invention in lieu of a fixed loading sequence. The selective loading sequence acts to maximize compressor operating efficiency through selective loading of compressors carefully matched to the nature and extent of the demand on the distribution system. During controller programming, data such as horse power, full load output pressure and the CFM (cubic foot per minute) rating associated with each compressor is entered into either an auto-calibration logic connected to the fixed sequencing logic in a logic controller or into the memory of a microprocessor controller. The first compressor in the sequence is then loaded in isolation while the controller measures the rate of system pressure rise to and fall from a predetermined value. The rates of pressure rise and fall may be used to compute compressor capacity and loading and unloading reaction time, and may be used together with the previously entered compressor data to provide a basis for computing overall distribution system volume, amount of leakage and other system parameters. The remaining compressors are also loaded in isolation and the corresponding rates of system pressure rise are measured to provide a basis for computing the relative output capacity and loading and unloading reaction time for each remaining compressor. The system parameters and relative compressor output capacities and reaction times are stored and subsequently utilized by the selective sequencing control in determining which compressor or group of compressors can be most efficiently loaded in order to maintain distribution system pressure at a specified target value. Changes in system pressure resulting from variations in demand on the distribution system can be detected by a single or multiple pressure transducers, whereupon the transducer output causes the controller to initiate the selective loading sequence.

A system calendar tracks the passage of time and transfers controller operation between the several loading sequences in accordance with programmed transfer intervals. Provisions are also made for independent, individual control regardless of the loading sequence in effect at the moment.

The features, objects and advantages of the present invention will become apparent from the following Brief Description of the Drawings and Best Mode for Carrying Out the Invention.

BEST MODE FOR CARRYING OUT THE INVENTION

The multiple compressor controller of the present invention is primarily adapted for use with a multiple compressor system, but obviously the controller may be employed to control types of fluid pumps other than compressors. Consequently, for purposes of this disclosure, the terms "compressor" and "pump" will be used interchangeably.

Figure 1:
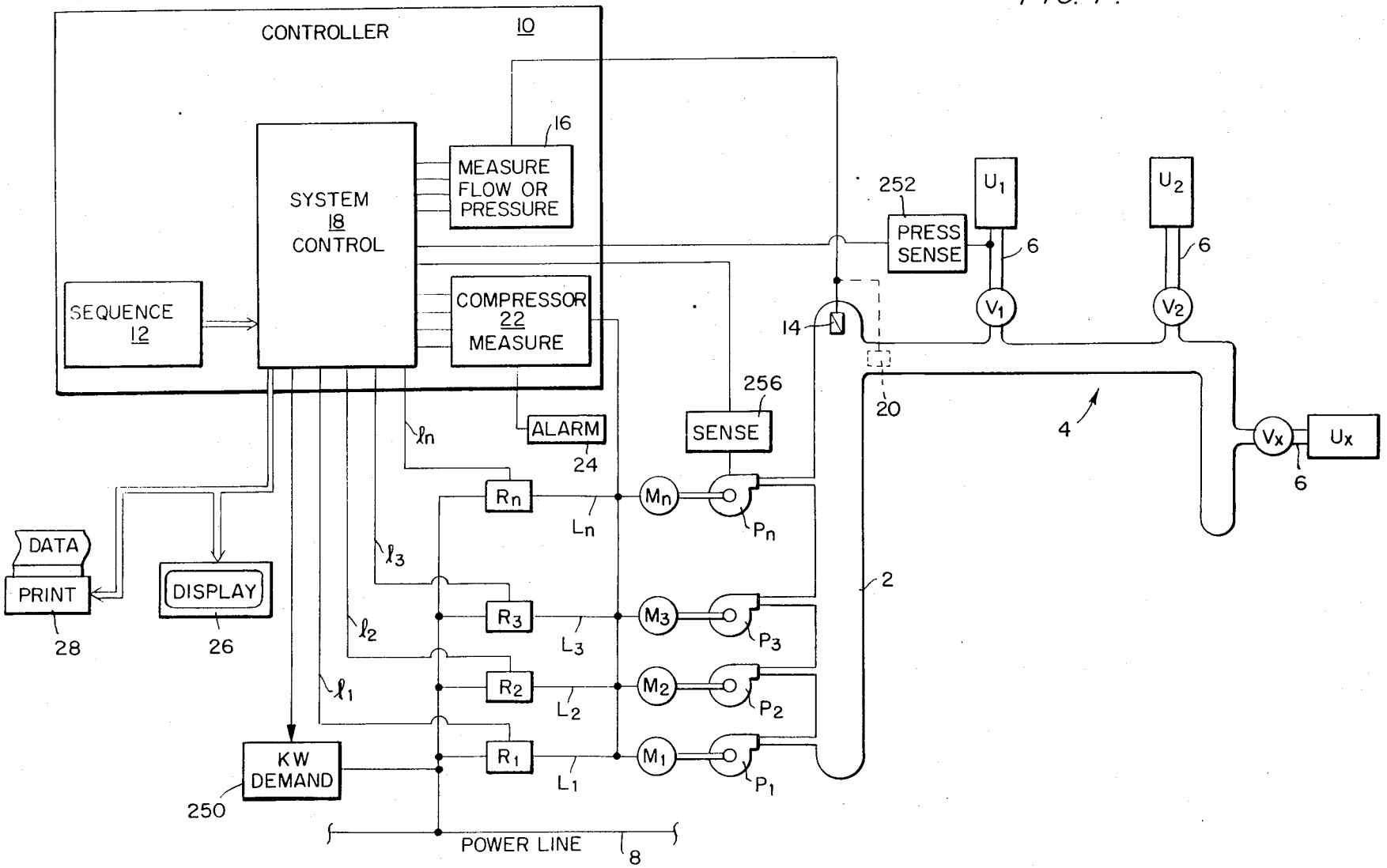
FIG. 1 is a schematic representation of a fluid distribution system having a plurality of variously-sized compressors adapted for control using the method of the present invention.

The multiple compressor system, shown schematically in FIG. 1, includes a plurality of compressors $P_1$, $P_2$, $P_3$, . . . $P_n$ which respectively supply manifold or plenum 2 with a working fluid under pressure. Compressors $P_1$–$P_n$ may, for example, comprise a series of reciprocating or rotary-type compressors having various air flow capacities. The working fluid from manifold 2 passes into fluid distribution network 4 and is thereafter conducted through branch conduits 6 to a plurality of remote utilization devices $U_1$, $U_2$, . . . $U_x$ in response to the selective actuation of control units $V_1$, $V_2$ . . . $V_x$. Compressors $P_1$–$P_n$ are respectively driven by a plurality of motors or engines $M_1$, $M_2$, $M_3$, . . . $M_n$. For the sake of convenience, these motors are illustrated as electric motors, but it is to be understood that other suitable drive means can be employed with appropriate modification to the compressor control circuits described hereinbelow.

A series of electrical feeder lines $\mathbf{1}_1$, $\mathbf{1}_2$, $\mathbf{1}_3$, . . . $\mathbf{1}_n$ connected through a corresponding series of compressor control units $R_1$, $R_2$, $R_3$, . . . $R_n$ to power line 8 respectively draw current for operating motors $M_1$–$M_n$. The opening and closing of the various relay control swithes for each compressor control the order of loading and unloading for compressors $P_1$–$P_n$ as well as various other compressor functions, and these are governed by a controller 10 in accordance with various compressor loading sequences programmed into the sequencing section 12 of the controller. The loading sequences are initiated whenever the demand on distribution network 4 causes the fluid pressure within the distribution network to change beyond certain predetermined limits. These fluid pressure changes may be detected by a single pressure transducer 14 mounted at one end of manifold 2, the output of which is processed in a pressure measuring section 16 of controller 10 to provide a set of switching signals. The switching signals are thereafter interfaced in a system control section 18 of controller 10 with the loading sequence data from sequencing section 12, whereupon the system control section supplies relays in control units $R_1$–$R_n$ with control signals which open and close the relays to load and unload compressors $P_1$–$P_n$ in the desired loading sequence.

It is necessary for the controller 10 to determine if a selected compressor has power and is ready to be started, and, subsequently, if a selected compressor has responded to the controller and is actually running. To sense the availability of each compressor, a relay in the control unit $R_1$–$R_n$ for each compressor may be provided to close a relay contact when the compressor has power and is ready to be started. This then provides a compressor availability signal to the controller 10. If the controller does not receive this signal, it will recognize that the chosen compressor is not available and will then select another compressor.

Similarly, even if a compressor is available and receives a start signal from the controller 10, it is important for the controller to determine if the compressor has responded and that the compressor did start and is running. This information can be provided to the controller by an auxillary contact on the compressor motor starter which closes when the motor starter starts the motor, or, alternatively, the signal could be provided by a shaft speed sensor which senses when the compressor motor shaft is turning. If the selected compressor does not respond to a start signal from the controller, the controller will select another compressor to start.

An alternate measure of control over the operation of pumps $P_1$–$P_n$ can be obtained by connecting a series of remote pressure responsive transducers throughout the distribution network 4 or at the outputs from the compressors to the manifold 2. Instead of pressure transducers, the system can also be controlled in response to a single flow sensor 20 positioned to measure fluid flow from the manifold 2 to the distribution network 4.

The controller 10 is also rendered responsive to conditions existing at the individual compressors $P_1$–$P_n$ by means of a compressor measuring section 22. An alarm device 24 connected to the controller may be used to alert the controller operator to any abnormal conditions which continue to exist in the system after all available compressors have been loaded. Information relating to the performance of the controller system, such as the identity of all compressors operating at any given time on any given date and the total fluid output capacity attributable thereto, can be furnished by a visual display unit 26 and/or a printout mechanism 28 connected to controller 10. The visual display may consist of a CRT or any similar alphanumeric display by which the controller can display various fluid system and alarm parameters.

Figure 2:
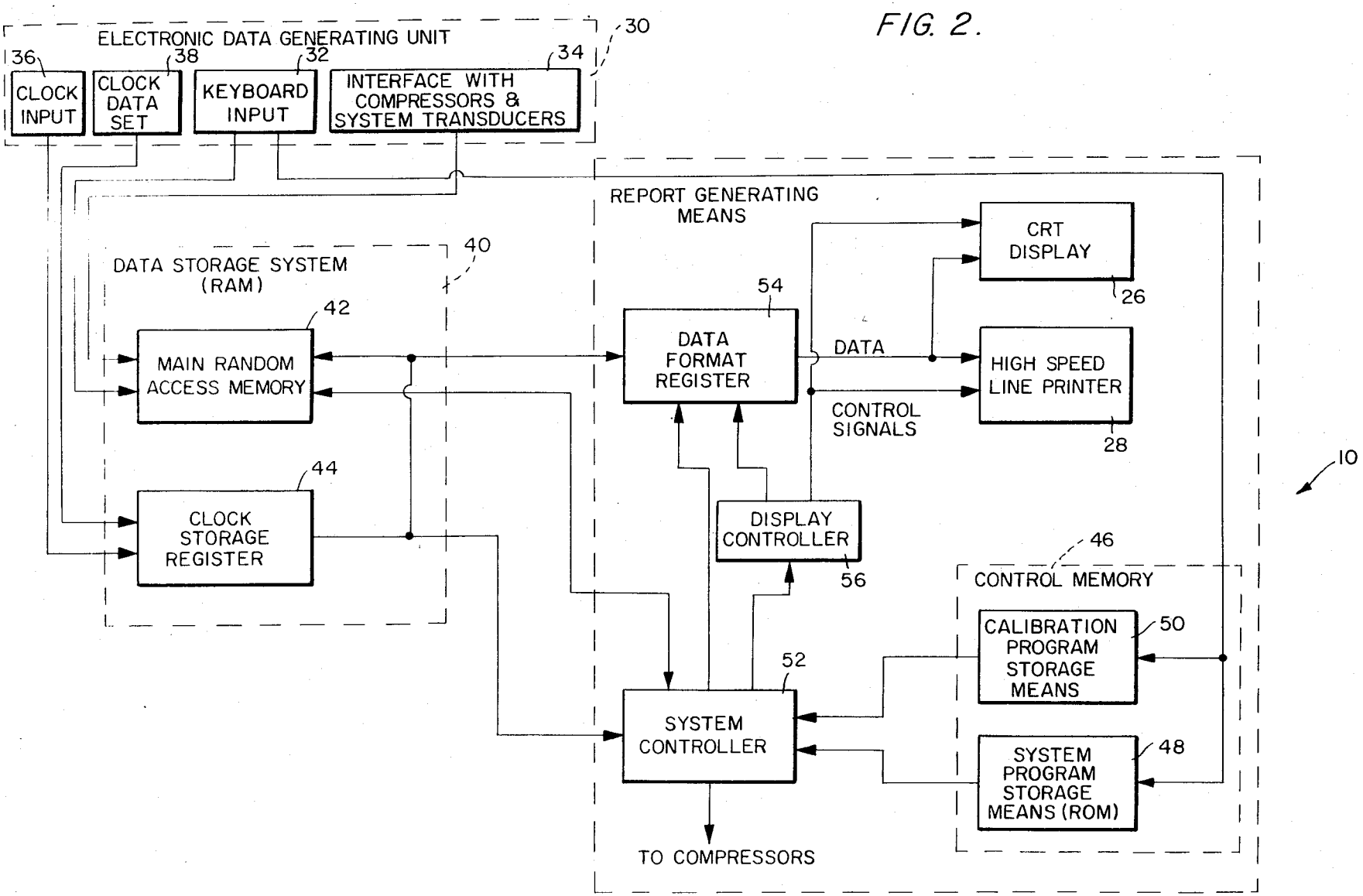
FIG. 2 is a block diagram illustrating one embodiment of a multi-compressor controller for implementing the method of the present invention.
Figure 3A:
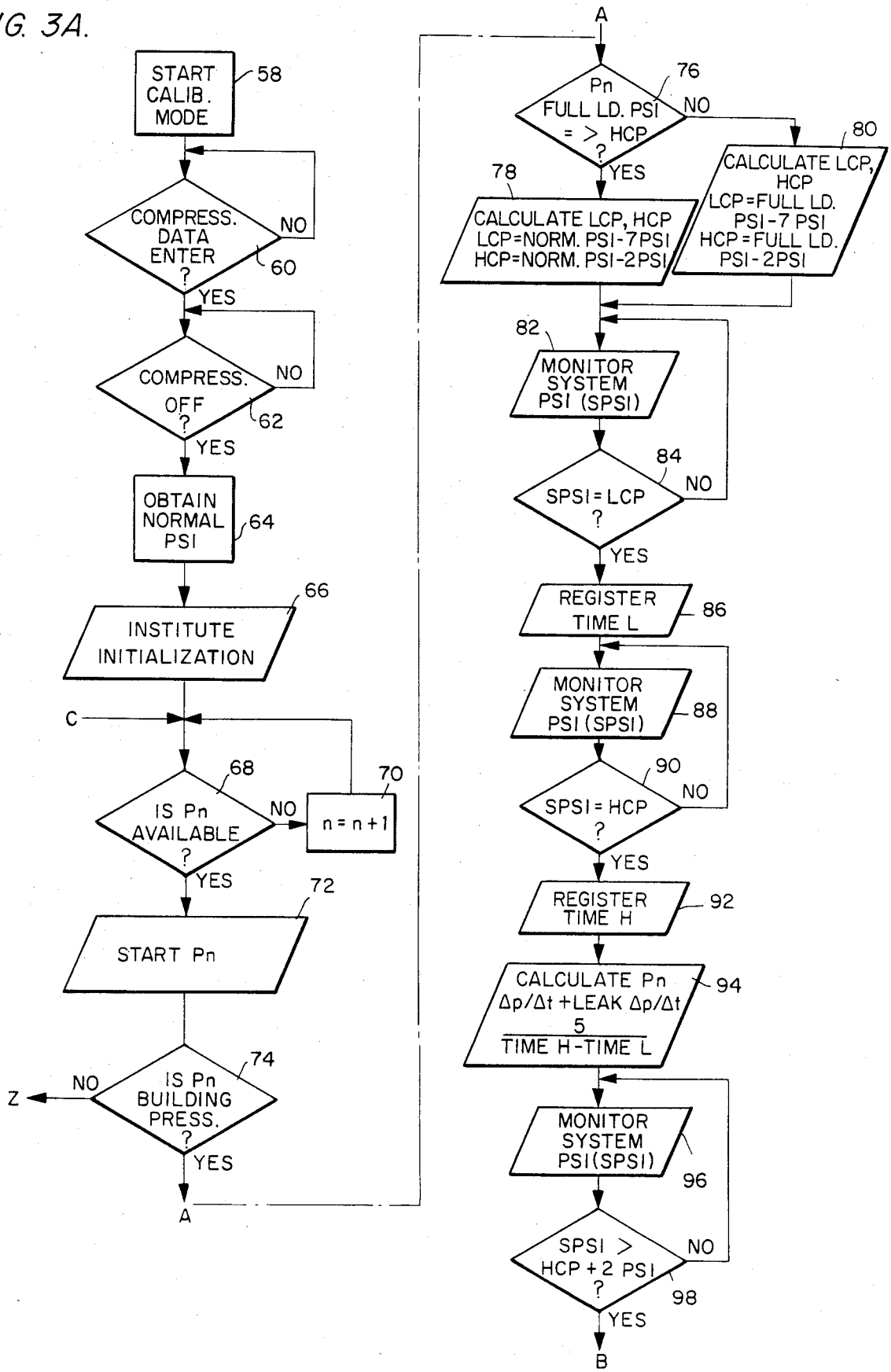
FIG. 3*a*, 3*b*, 4, 5 and 6 show the calibration steps employed by the controller of FIG. 2 to accomplish the method of the present invention.
Figure 3B:
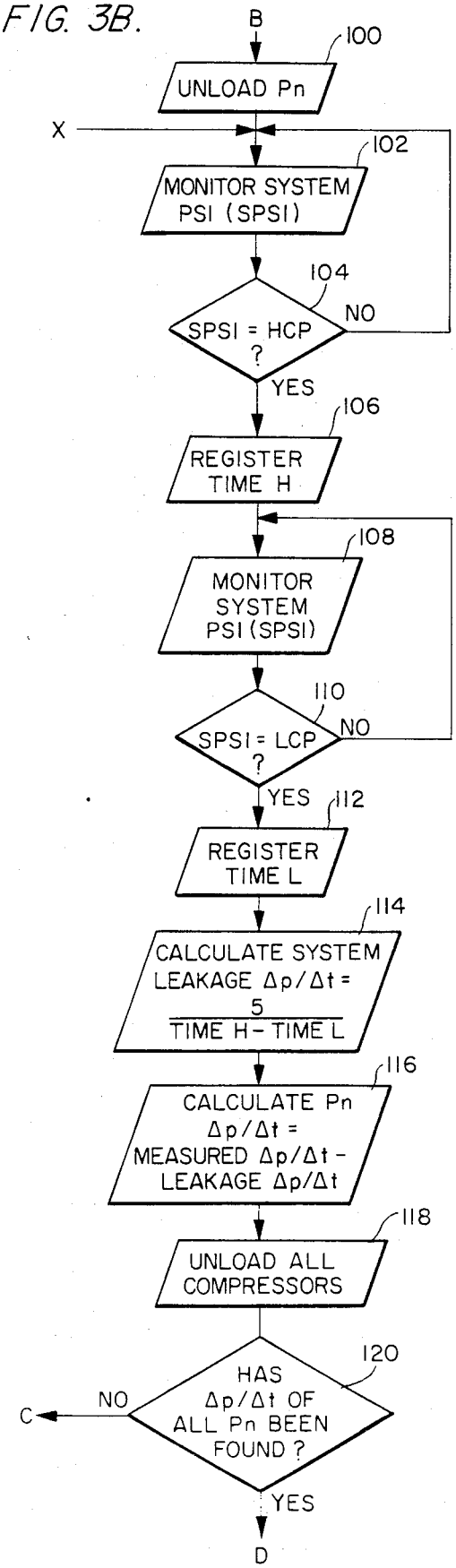

Referring now to FIG. 2, a detailed schematic diagram is provided of the hardware which may be employed to implement the controller 10 of FIG. 1. This controller operates in accordance with a combination of data manually set into the controller with data generated by switches, transducers, and other sensing means provided at the compressors as well as in the fluid distribution system. This data is provided to the system by means of an electronic data generating unit 30 which includes a keyboard input 32 adapted to facilitate the manual input of control data into the system storage as well as to set the controller for operation in various control modes, such as a program mode, a calibration mode, an auto control mode and a manual control mode. This keyboard input data is used by the controller in conjunction with data relating to the actual conditions existing within the fluid distribution system and at the various compressors which supply the system. All such data is provided to the system storage by means of an interface section 34 which is connected to various compressor switches and sensing components as well as to system transducers.

Finally, input data for the controller 10 is provided by a clock 36 which preferably constitutes a seven day, twenty four hour clock which is programmable by a clock data set section 38. The clock displays time in a twelve hour AM/PM format, and has battery backup power to provide at least forty eight hour protection in the event of main power failure.

The digital electrical data signals generated by the electronic data generating unit 30 are forwarded to a data storage system 40 which is designed to receive and store all of the electrical digital signals provided by both the electronic data generating unit as well as other portions of the controller 10. The data storage system includes a main random access memory 42 having a capacity which will be dictated by the capacity required to store substantially all of the data required for the operation of a specific multiple compressor system. The data storage system 40 can include additional storage registers, such as a clock storage register 44, which expands the capabilities of the main random access memory 42. In some instances, of course, the main random access memory can provide all of the memory required by the system, and this memory, like the clock 36, should be provided with emergency battery power.

The controller 10 operates in response to various programs stored within a control memory 46 which includes a main system program storage 48 that may be supplemented by additional program storage sections 50. If the main program storage is not of sufficient capacity to contain all of the programs required for all of the various modes of operation of the controller 10, the additional program storage 50 may be employed to store a specialized program, such as the calibration program for the controller.

A system controller 52 operates in accordance with data provided from the data storage system 40 and program control from the control memory 46 to sequence the various compressor control units $R_1$–$R_n$ to start, stop, load and unload compressors as required. In accordance with requirements provided by the control memory section 46, the system controller also provides control to a data format register 54 which combines data provided by the electronic data generating unit 30 into a format which may be stored in the main random memory for further control functions and which may also be selectively displayed on the display unit 26 and the printer 28. Also under the control of the control memory 46, the system controller 52 causes a display controller 56 to activate the CRT display 26 and high speed printer 28 to display data selected by the various programs from the data storage system 40.

Although the controller 10 could be implemented with comparators and conventional logic circuitry known to the art to compare measured pressure readings from the pressure transducer 14 against preset stored pressure readings and to operate a sequencer in accordance therewith to load or unload the various compressors of the multiple compressor distribution system, a microprocessor controller of the type shown by FIG. 2 provides much greater versatility for carrying out the method of the present invention. A microprocessor multiple compressor controller can be programmed to calculate the size of a controlled air system using the actual compressors which supply the system.

Program Mode

The controller 10 operates in accordance with the relationship between the data continuously generated by the interface section 34 and that programmed into the controller during a program mode thereof. The program mode is initiated by the keyboard 32 and may be employed to enter a daily sequence, system parameters and compressor data into the data storage system 40. The daily sequence entry is programmable by first entering a time on the clock data set 38 and then keying in either a zero or a desired target pressure on the keyboard input 32. A zero entry indicates that an idle control is called for where the controller does not activate any compressor but waits until the start of the next time period. On the other hand, if a pressure indication is keyed into the keyboard, then that pressure is to be maintained by the controller 10 in the distribution system until the next time entry.

Assume, for example, that a company has two shifts with the first shift starting at 7:00 AM and ending at 3:15 PM when the next shift starts. The second shift ends at 11:30 PM and subsequently there is no need to employ the fluid distribution system until the next 7:00 AM shift. Assuming that the first shift requires 105 psi be maintained in the air distribution network while the second requires 95 psi be maintained, then this information would be entered into the data storage system 40 using the keyboard 32 and the clock data set 38 as follows:

| Step | Entry | Set In |
|---|---|---|
| 1 | Time | 7A |
| 2 | Pressure | 105 |
| 3 | Time | 315P |
| 4 | Pressure | 95 |
| 5 | Time | 1130P |
| 6 | Pressure | 0 |

The above sequence set into the clock storage register 44 indicates that at 7:00 AM, the system target pressure is to be 105 psi and is to be maintained until 3:15 PM. At 3:15 PM, the system target pressure is to be dropped to 95 psi and this will be maintained until 11:30 PM. At 11:30 PM, an idle period is to start where the system pressure is 0, and this idle period will run until the next pressure period which will be at 7:00 AM on the next day that this sequence is to be run. After the sequence is set as follows, then the keyboard is actuated to indicate the first two letters of each day upon which the sequence will be run. Thus, this sequence will be activated under the control of the seven day twenty-four hour clock input 36.

In addition to programming the weekly compressor schedule into the clock storage register, the keyboard input 32 may be used to program in a holiday option. Thus, by indicating "Holiday" on the keyboard, the controller can be told to skip the normal schedule programmed for the day upon which the holiday falls and to substitute another schedule for that one day. A similar option can be substituted for any non-standard control day; i.e., strike days, plant shutdown days, or overtime days. The special schedule for these days can be automatically initiated by the controller 10 which can be programmed in advance to include these non standard control days in a programmed weekly or monthly scheduled sequence.

The keyboard may be used to extend or override the programmed time schedule. When an override input is provided, the controller will ignore the time clock and continue the control action in progress when the override function was initiated. This will continue until the override function is manually removed by activating the keyboard. Similarly, the programmed pressure may be overriden during the override function by manually entering a new pressure. The controller will now ignore the programmed time clock and control continuously to the new pressure until the override function is terminated.

The time clock can be programmed to cause the controller 10 to automatically pre-initialize auxillary compressor equipment before starting the compressors. Thus, prior to the start of a control period, the controller can be programmed to energize an output to the auxillary compressor equipment.

Similarly, the clock can be programmed to cause the controller to begin starting compressors prior to a programmed control period. This will insure that the system pressure is brought to a level equal to, or greater than, the target pressure to be maintained during the control period prior to the start of the control period.

In the program mode, it is also possible to enter data relating to system parameters into the main random access memory 42. For example, the system should induce an initialization period for the compressor system during which pumps or lubrication systems which need to be run before certain compressors can be run are started. Thus, the time that the initialization period is to run may be programmed into the data storage system 40 along with an identification number indicating each compressor having pumps or lubrication systems which need to be started. Compressors may be identified by number in accordance with the number of compressors $P_1$–$P_n$ in the system, so that in an eight compressor system the individual compressors will be identified by the numbers 1 through 8.

After the initialization period, the controller 10 will need to institute a build period. This build period is interposed between a pressure controlled sequence and a preceding idle period, and provides time to permit the controller to start a sufficient number of compressors in order to bring the distribution system up to pressure. The build time for accomplishing this during the build period is calculated with values determined during a calibration mode, to be subsequently described, from the chosen compressors $\Delta_p/\Delta_t$ and the system leakage $\Delta_p/\Delta_t$ such that the build time T equals the target pressure divided by compressor $\Delta_p/\Delta_t$ minus leakage $\Delta_p/\Delta_t$.

The other system parameters to be manually entered are the upper deadband pressure level and the lower deadband pressure level. Neither of these pressure levels should be set to less than 3 psi. The controller will unload compressors when the system pressure rises above the upper deadband pressure level (UDL) and will add compressors when the system pressure falls below the lower deadband pressure level (LDL).

After the setting of the deadband levels, the low pressure point for the controller can be set. This low pressure point should not be set above the lowest deadband value. Thus, if the lowest programmed target pressure set during the daily sequence entry is 95 psi and the lower deadband pressure has been programmed to be 5 psi, then the highest value for the low pressure point would be 90 psi.

Finally, compressor data can be programmed into the main random access memory 42 for each compressor $P_1$–$P_n$ to be controlled by the controller 10. First, the compressor number is keyed into the data storage system and after each compressor number, the compressor CFM is entered, the full load pressure for the compressor, the priority of the compressor and the horsepower for the compressor. The compressor priority may include the sequence of compressors when a fixed sequence mode of operation is to be initiated by the controller 10. This priority setting is also important when different types of compressors are employed in the multiple compressor system. For example, there are certain types of compressors that once started, should not be unloaded. In other cases, there may be a group of small compressors which are mixed with one or two extremely large compressors. Here, it may not be desirable to start these large compressors until there is adequate demand for them or until all of the smaller compressors are running. This basically puts these compressors last in priority, but once they are started, they should not be the next compressor to be unloaded. In fact, these compressors should be the last to be unloaded after all of the other small compressors have been unloaded.

This method allows the controller to use the small compressors in groups until the larger more efficient compressors are needed. Once loaded, these large compressors run as base loading machines with the smaller compressors acting as fill compressors.

After priority and horsepower information, specialized compressor information can be entered such as an indication as to which compressors have reduced voltage starters. Also, the run time for each compressor can be entered so that the controller can even out the run time of the various compressors in the system as it chooses compressors to put on line. Equal compressors are those whose motor horsepower and priority match, and the controller will prompt rotation among these compressors in accordance with compressor run time. Thus, when the controller must start a compressor in a system which includes other equal compressors, the controller will choose among the equal compressors based on run time. The controller could be set up to equalize the run time among equal size compressors or maintain a predetermined run time difference between equal size compressors. This would allow for replacing and/or maintaining all equal size compressors at approximately the same time or spreading maintenance and/or replacement over time.

Finally, with the controller in the program mode, some general parameters may be entered such as the target pressure to be maintained by the system when it is run in the manual control mode. Also, the maximum starting amount of horsepower (MSH) that the plant power distribution can tolerate starting at one time must be entered so that the starting of the compressors does not interfere with the plant power distribution. This maximum amount of horseplant power or available starting horsepower must be taken into consideration by the controller at the beginning of any control period. When a compressor is about to be started, the controller compares the compressor's effective starting horsepower (ESH) to the maximum amount of horsepower which the plant power distribution system can accomodate.

Calibration Mode

In the calibration mode, the controller 10 is calibrated to the distribution system. The initial calibration operation and subsequent auto-calibration operations are required to obtain compressor and system data for storage in the random access memory 42. This data is then employed by the controller 10 for computer aided compressor evaluation and selection. After the controller is placed in the calibration mode, (step 58), calibration operations occur under the control of the calibration program stored in the control memory 50 as outlined in FIGS. 3A, 3B, 4 and 5. Calibration can only occur after all of the compressor data has been entered into the data storage system 40 (step 60). Also, calibration can only be accomplished from the off mode (step 62) when no programmed or manual control of the compressors is occurring and all the compressors are shut down. In the calibration mode, with the normal system pressure entered (step 64), the controller will institute the initilization period (step 66), and once initilization is complete, the controller starts the first compressor available (steps 68–72). If the controller senses that this newly started compressor is building pressure against system leakage (74), a calibration range will be calculated for that compressor.

Each compressor used during the calibration mode is calibrated to a range (for example 5 psi) that starts at a low calibration point (LCP) which is below the normal system pressure entered (for example 3 psi below) and which ends at a high calibration point (HCP) which is above the normal system pressure (for example, 2 psi above) (step 64). The controller will use this range to calibrate a compressor as long as the compressor's full load pressure is equal to or greater than the high calibration point (steps 76 and 78). If this is not the case, then the controller must establish a calibration range for this compressor that has a high calibration point that ends below the compressor's full load pressure (step 80).

After the controller has started an available compressor and determined that it is building pressure in the system, the controller monitors the rise in system pressure and times the pressure rise from the low calibration point through the high calibration point (steps 82–92) and divides the calibration range (i.e. 5 psi) by the result to obtain the system leakage $\Delta_p/\Delta_t$ plus this compressor's $\Delta_p/\Delta_t$ (step 94). The controller then lets the pressure rise above the high calibration point (steps 96 and 98) before unloading the compressor (step 100). The controller then times the period required for the pressure to fall from the high calibration point to the low calibration point (steps 102–112) and divides the calibration range by this time to get the system leakage $\Delta_p/\Delta_t$ (step 114). The compressor's actual $\Delta_p/\Delta_t$ is equal to the rising $\Delta_p/\Delta_t$ minus the system leakage $\Delta_p/\Delta_t$ (step 116).

The controller then starts the next available compressor (steps 118–120) and finds its rising $\Delta_p/\Delta_t$. By subtracting the system leakage $\Delta_p/\Delta_t$ from the rising $\Delta_p/\Delta_t$, the compressor's actual $\Delta_p/\Delta_t$ is found. The controller continues this practice of starting individual compressors in order to find the $\Delta_p/\Delta_t$ of each compressor.

Figure 4:
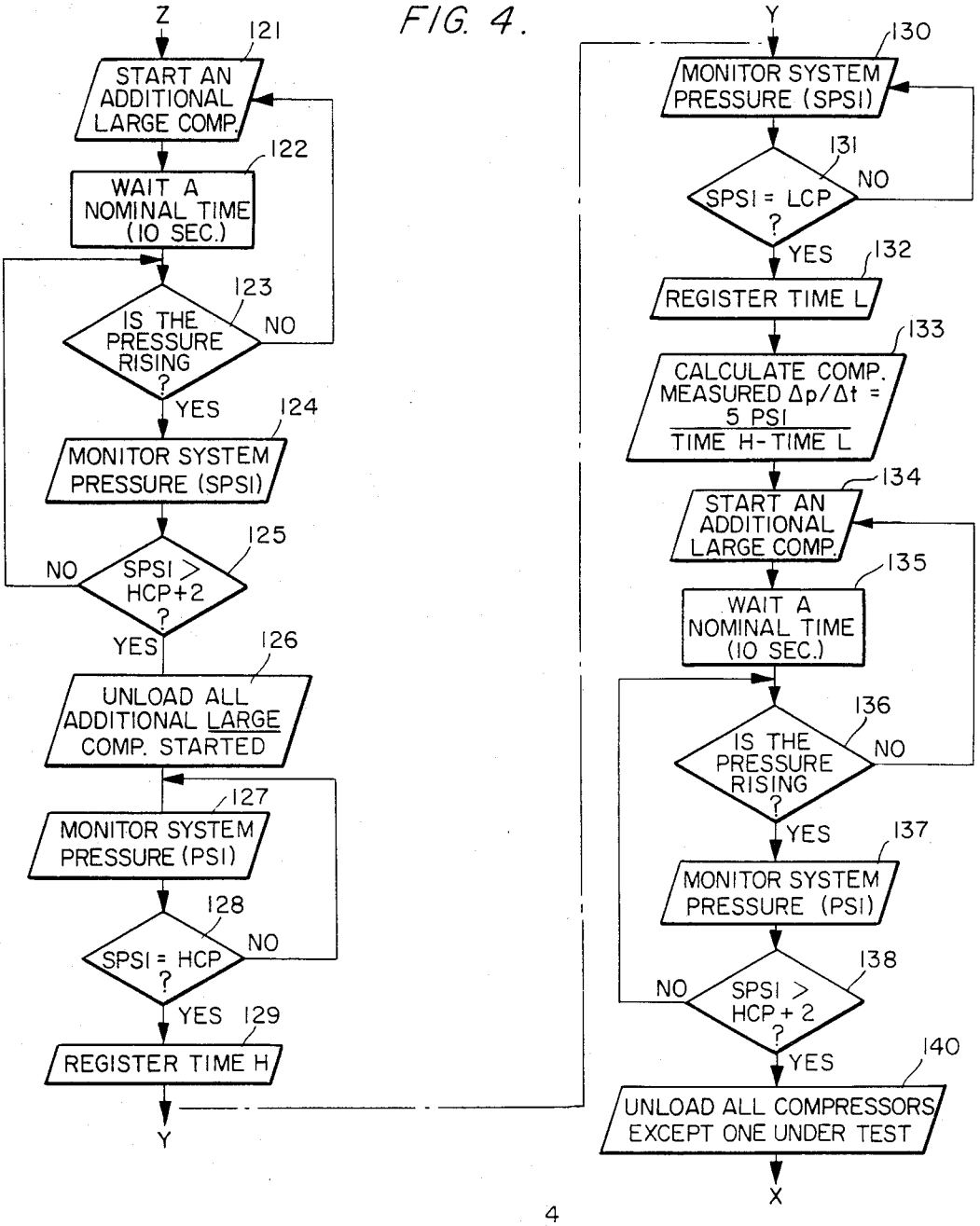

If a compressor cannot build pressure against the system leakage, the controller can still determine compressor and system leakage $\Delta_p/\Delta_t$ by an alternative method (FIG. 4). In this case, the controller must use enough compressors to build the system pressure to the desired point above the high calibration point (steps 121–125). The controller then unloads all of the compressors (step 126) and times the period it takes the pressure to fall from the high calibration point through the low calibration point (steps 127–132) and then divides this time by the calibration range; i.e 5 psi, to get the system leakage $\Delta_p/\Delta_t$ (step 133). Then, the controller again loads enough compressors to build the pressure in the system to the same point above (i.e. 2 psi above) the high calibration point (steps 134–138) and subsequently unloads all of the compressors except the compressor for which it is trying to find the $\Delta_p/\Delta_t$ value. The controller times the slower falling pressure from the high calibration point through the low calibration point and divides this number by the calibration range and then subtracts the negative system leakage $\Delta_p/\Delta_t$ to get the actual $\Delta_p/\Delta_t$ of the loaded compressor. The controller continues this method until a $\Delta_p/\Delta_t$ is found for each of the remaining compressors.

Once the controller 10 has found the system leakage $\Delta_p/\Delta_t$ and the $\Delta_p/\Delta_t$ of each individual compressor in the system, the controller will then proceed to determine the Loaded Reaction Time (LRT) and Unloaded Reaction Time (URT) for each compressor. There is a time delay unique to each compressor between the time when the compressor is loaded and the time when the compressor reaches a full capacity output condition, and this delay is the compressor loaded reaction time. Most loaded reaction times range from five to fifteen seconds. Similarly, each compressor has a short but significant delay known as the unloaded reaction time between compressor unloading and the time when the compressor fully ceases to provide air to the distribution system. These loaded and unloaded reaction times must be considered by the controller 10 when the controller provides computer aided compressor evaluation and selection.

To find the unloaded reaction time for compressors that are capable of building pressure against the system leakage, (FIG. 5), the controller 10 checks to make sure that all compressors are unloaded and that the system pressure is below the lower calibration point LCP (steps 142 and 144. The controller then loads the compressor to be tested (step 146), and when the system pressure reachesthe high calibration point (steps 148 and 150) the controller unloads the compressor and starts timing (step 152) until the fall rate equals the system leakage $\Delta_p/\Delta_t$ (steps 154–158). This time is the unload reaction time of the tested compressor (step 160). The controller then continues this process until the unload reaction time of all of the system compressors has been recorded (step 162).

The next step in the program calibration function is for the controller to find and record the loaded reaction time (LRT) of the compressors. A compressor must be completely stopped and then started to have its loaded reaction time calculated (step 164), and therefore one or more of the remaining compressors in the system are used to build system pressure back to the selected point above the high calibration point (166–170). When the system pressure is high enough, the controller unloads all of the compressors with the exception of the compressor to be tested, for this compressor is already completely stopped (step 172). The controller then waits for the longest, previously calculated unload reaction time (steps 174 and 176) before starting the stopped compressor to test it (step 178), and after this compressor is started, the controller times the period from the compressor start up to a point where the system $\Delta_p/\Delta_t$ has increased above the system leakage by the $\Delta_p/\Delta_t$ of the compressor under test (steps 180–184). This time is the loaded reaction time of the compressor (steps 186 and 188). The controller then proceeds to find the loaded reaction time of all of the compressors.

An alternate method may be employed to determine compressor unloaded reaction time if there are small compressors that cannot build pressure against the system leakage $\Delta_p/\Delta_t$. In this situation, the controller will run enough compressors, including one single small compressor to be tested, to again build the system pressure to the same point above the high calibration point. The controller will then unload the large compressors and wait until the pressure has fallen to the high calibration point where it will unload the small compressor. The controller then starts timing from the small compressor unloading time to when it first detects that the system $\Delta_p/\Delta_t$ has changed to the $\Delta_p/\Delta_t$ of the system leakage. This time then is the reaction time (URT) of the small compressor. The controller continues this process until it finds the unloaded reaction time of all small compressors that cannot build pressure against the system leakage $\Delta_p/\Delta_t$.

Figure 6:
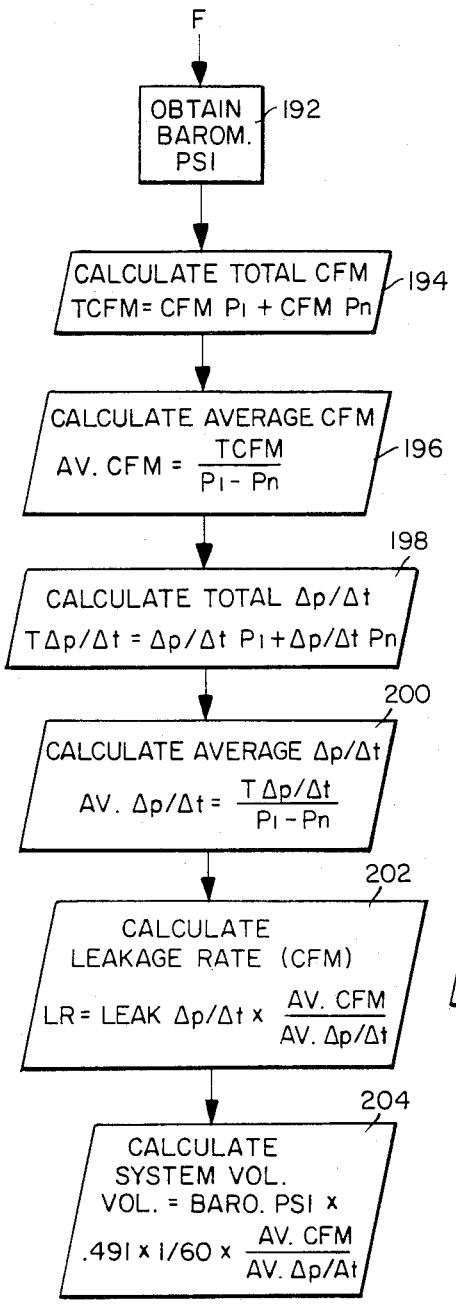

During the calibration mode operation, the controller 10 has determined the $\Delta_p/\Delta_t$ of each compressor, has determined the system leakage $\Delta_p/\Delta_t$, and has determined the loaded reaction time and unloaded reaction time for the compressors. These calculations are then stored in the random access memory 42 for future use. The controller is now ready to complete final computation (FIG. 6). The controller will first call for an average barometric pressure value (step 192) which may be either entered manually by means of the keyboard 32 or retrieved from the main random access memory 42 where it was stored as a result of a previous manual or transducer entry. With the average barometric pressure, the system leakage $\Delta_p/\Delta_t$, the CFM entered for each compressor, and the $\Delta_p/\Delta_t$ for each compressor, the controller can now calculate the total CFM, the system leakage CFM and the system volume in cubic feet. To accomplish this, the total CFM of the compressors $P_1$–$P_n$ is obtained by summing the individual CFM values of each compressor (step 194), and then an average CFM is derived by dividing the total CFM by the number of compressors (step 196).

Similarly, a total $\Delta_p/\Delta_t$ value is obtained by summing the $\Delta_p/\Delta_t$ values for each individual compressor (step 198) and then an average $\Delta_p/\Delta_t$ is found by dividing the total $\Delta_p/\Delta_t$ by the number of compressors (step 200).

The system leakage rate in CFM can be calculated using the following formula and values present in the controller (step 202):

$$\text{Leakage Rate CFM} = \text{leakage}\Delta_p/\Delta_t \times \frac{\text{Average CFM}}{\text{Average } \Delta_p/\Delta_t}$$

The system volume in cubic feet may then be calculated as follows (step 204):

$$\frac{\text{Average CFM}}{\text{Average } \Delta_p/\Delta_t}$$

Once these values have been calculated and stored, the calibration program is complete. To periodically update these values, it is possible for the calibration program to be activated periodically by data set into the clock storage register from the clock data set so that automatic recalibration will occur during controller idle periods. This can be done by entering the number of days which should pass between calibrations. When the time comes for automatically recalibrating the system, the controller 10 will choose an idle period within which calibration can be accomplished.

Control Modes

Normally, the controller 10 operates in one of the automatic control modes to be subsequently discussed. However, the controller can also be placed in a manual control mode, and when a manual control command is keyed into the controller, all other modes of control are overridden. In the manual control mode, the controller maintains the preprogrammed manual target pressure stored therein during the program mode, and the controller will ignore all time periods stored in the clock storage register 44. When the manual control mode is terminated, the controller will reinitiate the automatic control mode which was interrupted by the manual mode.

It must also be noted that the controller can be governed by manually entered values for system leakage and compressor reaction times rather than using the values obtained by an automatic calibration procedure.

The two basic automatic control modes provided by the controller 10 to control the compressors $P_1$–$P_n$ are the set sequence control mode and the computer aided compressor evaluation and selection mode. In the set sequence control mode, the priorities given to the compressors for the computer aided compressor evaluation and selection mode are overridden, and the compressor sequence set into the main random access memory during the program mode determines the order in which compressors are started, loaded and unloaded. For example, the controller must load and/or start compressors in sequential order from first to last and unload from last to first. If a sequence of compressor numbers 5, 3, 2, 1, 4, and 7 is entered during the program mode as the control sequence for the set sequence control mode, then compressor #5 is the first to be started and compressor #7 will be the last. Compressors #5, #3, and #2 must be running loaded before compressor #1 is started and/or loaded. Compressors #7, #4, and #1 must be unloaded before compressor #2 can be unloaded, and compressor #2 must be unloaded before compressors #3 and #5.

The controller will unload a compressor when the system pressure rises above the set Upper Deadband value (UDB), and then will wait for a delay period, i.e., three seconds, and if the pressure has not started to fall, it will unload the next compressor in the sequence. The controller will continue unloading compressors and waiting in this manner until either the sensed system pressure starts to fall or all the compressors are unloaded. If the controller unloads all of the compressors and the pressure still does not start to fall within a predetermined delay period, the controller 10 will institute a transducer check routine to be described.

When the system pressure falls below the set Lower Deadband value (LDB), the controller 10 will start and/or load the next compressor in the sequence. The controller will wait for a set delay period, which is the loaded reaction time of the compressor if calibrated. When the compressor has not been calibrated, the delay time is entered by means of the keyboard 32. If the pressure continues to fall or if it doesn't start to rise, then the controller will start and load another compressor. The controller will continue this operation until the system pressure starts to rise or until all of the compressors are running loaded.

While the system pressure is within the control range between the lower deadband to upper deadband limits, the controller will not start, load or unload any compressors. If the pressure should rise above or fall below these limits, the controller adds or removes compressors as required to cause the system pressure to return to the limited control range. As long as the system pressure is heading back towards the control range, the controller takes no further action. If the pressure should stop falling or rising toward the control range and the appropriate time delay has elapsed subsequent to the last action, the controller unloads or loads compressors as necessary to get the pressure headed in the right direction.

If system pressure falls to the preset Low Set Point (LSP), the controller is to load and/or start all compressors as soon as possible. The controller can start compressors in groups and should use the start constraints that will subsequently be described. The controller should continue starting compressors until all compressors are running loaded or until system pressure is above the low set point.

It is possible, in accordance with the present invention, to program the controller 10 so as to operate the compressors $P_1$–$P_n$ in a modified set sequence control mode. First a modified set sequence control program may be provided which permits the periodic rotation of the lead compressor in the sequence. When the daily sequence is entered into the clock storage register 44 during the program mode, a clock entry may be made to cause the timed rotation of the lead compressor in the set sequence control mode. Thus the controller 10 may be set to rotate the lead compressor once a day, once a week or once a month, or after the expiration of some other set time period. For example, if the present compressor sequence is compressor numbers 5, 3, 2, 1, 4 and 7 for the set sequence control mode and the controller is programmed to rotate the lead compressor daily, then on the second day of set sequence operation, the control sequence will be compressor numbers 3, 2, 1, 4, 7 and 5, the third day sequence will be compressor numbers 2, 1, 4, 7, 5 and 3, etc. This rotational sequence evens to a great extent the run time on the system compressors.

Some compressors can be operated in a modulate mode to provide less than full air pressure to a distribution system. When compressors of this type are operated in the set sequence control mode, the controller can be programmed to place the next compressor to be loaded in the modulate mode of operation. For example, as each successive compressor starts, the controller operates all previous compressors started at full load and places the compressor just started in the modulate mode. If the system air pressure now rises above the upper deadband limit, the controller will unload the last compressor started and cause the compressor just prior to the one unloaded to switch to the modulate mode.

When the compressors $P_1$–$P_n$ include one small compressor, the controller 10 can be programmed for set sequence operation so that this small compressor will be loaded and unloaded between the start up and shutdown of two adjacent large compressors in the sequence. In the previous sequence of compressor numbers 5, 3, 2, 1, 4 and 7, if compressor 7 is the small compressor, then the new modified loading sequence will be 7 (ld. and unld.) 5(ld.) 7 (ld. and unld.) 3(ld.) 7 (ld. and unld.) 2 (ld.), 7(ld. and unld.) 1(ld.), 7(ld. and unld.)

4(ld.) 7(ld.). The unloading sequence will be the reverse of the loading sequence with 7(unld.) 4(unld.), 7(ld. and unld.) 1 (unld.) (7(ld. and unld.) 2(unld.) etc. In this sequence, if compressor 7 is a 100 HP compressor and the remaining compressors are 200 HP compressors, then the controller will sequence the compressors in total horsepower steps of 100 HP; i.e., (7) 100 (5) 200 (5 plus 7) 300 (5 plus 3) 400 (5 plus 3 plus 7) 500 (5 plus 3 plus 2) 600 etc. Also, the large compressors in this sequence can be rotated by programming the rotation of the large lead compressor in the manner previously described. In this rotation scheme, the small compressor would continue as the fill or trim compressor and would not be rotated.

When the controller 10 initiates the computer aided compressor evaluation and selection mode (CACES), full use is made of the data entered during the program mode and that calculated during the calibration mode to provide automatic compressor selection from a group of various sized compressors. In the CACES mode, the controller 10 is not inhibited by a set sequence, but instead attempts to select a compressor or group of compressors with an output capacity that equals or slightly exceeds the air system demand at a given control point in time. By running only those compressors needed at maximum capacity, a substantial saving in energy can be realized. Since the controller 10 has stored the relative output capacity of each compressor as well as the volume and leakage of the air distribution system, it can readily calculate the change in system demand by measuring the rate of system pressure change. With a single transducer 14, the controller can receive system pressure information that will facilitate the calculation of present air demand and enable the controller to select those compressors that best match this demand.

In still another method of selective control, the controller takes into accouht the total air demand of the system. The total demand of the system is the summation of the outputs of those compressors already loaded plus any increase in demand or minus any decrease in demand. With this method, the controller attempts to find the fewest compressors necessary to meet the total present system requirements. The controller tries to find a single large compressor or small group of large compressors that, when loaded, will satisfy the total demand and cause the system pressure to rise, forcing the unloading of the smaller, less efficient, compressor. An example would be a system having two compressors loaded—one a 1 psi/sec compressor and the other a 5 psi/sec compressor. If the demand should increase to the point of requiring another compressor capable of 3 psi/sec, the controller using this method would try to find a single, larger compressor capable of 9 psi/sec, thus forcing the unloading of the other two compressors. If a 9 psi/sec compressor is not available, the controller would try to select an 8 psi/sec compressor forcing a later unloading of the 5 psi/sec compressor. If an 8 psi/sec compressor is not available, then the next best choice would be a 4 psi/sec compressor, causing the unloading of the 1 psi/sec compressor. In this selective control mode, the controller is biased towards running as few compressors as possible, thus running as large a compressor as possible. This prejudice towards running a few large compressors will yield a highly effective mix of compressors for relatively normal, stable system demands.

In addition to selecting a group of compressors that most closely match the demand, the controller can determine from the selected group's stored load and unload reaction times, when it would be necessary to load or unload the compressors based on the system's $\Delta_p/\Delta_t$ so that the change in the group's output would occur just prior to the system pressure reaching the UDB or LDB. In prior art controllers, the control action would not be initiated until the system's pressure fell or rose to the set points. Using this prior method, the system pressure would naturally rise above or fall below the set points prior to the controller's action becoming effective. With the present invention, the controller selects the appropriate compressor or group of compressors and then determines at what pressure level control action must take place so that the system pressure does not rise above nor fall below the appropriate set points. With the controller's new style predictive control action based on the system pressure, the system pressure's $\Delta_p/\Delta_t$, and the selected compressor's reaction time, the fluctuation of system pressure can be controlled much closer to the upper and lower set points than has previously been possible.

Since the compressors $P_1$–$P_n$ have a variety of reaction times which are required to bring the compressor to speed and full air production, the controller 10 must calculate a system pressure level which is above the low set point pressure where the system pressure would not be permitted to fall below the low set point pressure if all compressors were started as soon as possible. This point is the reaction pressure critical point (RPC) and may be calculated by the controller during the calibration mode or, using the values stored during the calibration mode, this RPC may be calculated upon the initiation of the CACES control mode.

Figure 7:
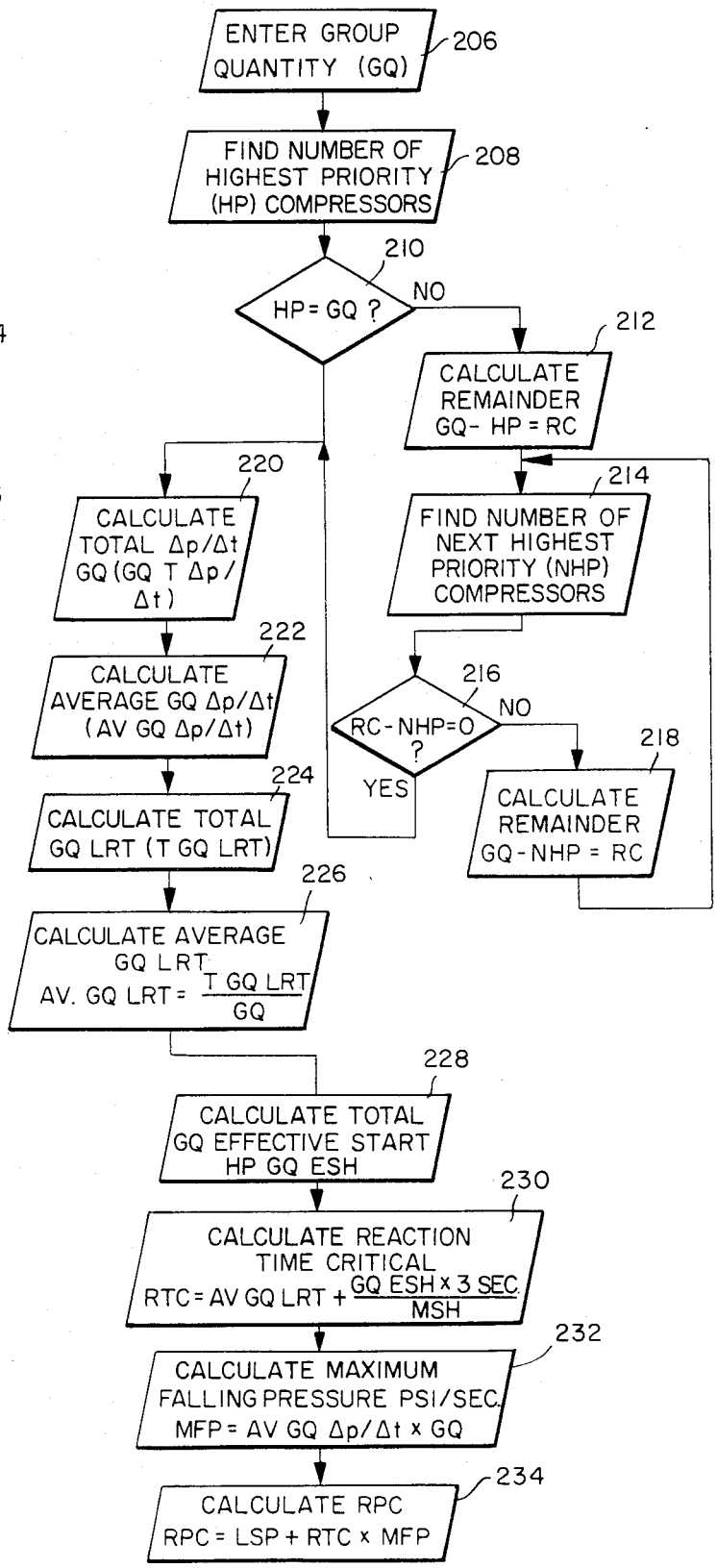
FIG. 7 shows the steps employed by the controller of FIG. 2 to establish a critical reaction pressure.

It will be recalled that the low set point pressure set into the controller during the program mode is the minimum pressure which the distribution system should have during any pressure control period. Therefore, the controller 10 must act promptly when system pressure drops to or below RPC to load a sufficient number of unloaded but running compressors immediately within the dictates of the preset priority classes to avoid having the system pressure fall below the low set point. The controller must then start all compressors from the largest to the smallest within each priority class according to horsepower start constraints, although this startup procedure can be terminated as soon as system pressure rises above the RPC. To calculate the RPC for use as a control function, (FIG. 7) the number of compressors the controller must load is entered (step 206). This number is known as the group quantity (GQ), and if the group quantity is set to zero, then the reaction pressure critical point is equal to the low set point pressure.

Once the controller knows the group quantity of compressors to be used, it starts selecting the compressors from the highest priority compressors (step 208) (NOTE: The lower a compressor's priority number, the sooner it will be started by the controller.) The controller must select all of the compressors within the highest priority class. If this class holds a number of compressors which are equal or greater than the group quantity (GQ) required, the controller has finished selecting the group (step 210). If this priority class has less than the number required for the group, the controller subtracts the number of compressors in this priority from total group quantity (step 212) and looks at the next highest priority class (step 214). The controller will go from the highest to lowest priority class selecting all of the compressors in each class and subtracting the number in each class from the group quantity until the required number of compressors has been selected (steps 216 and 218).

After finding the group, the controller must calculate the Average $\Delta_p/\Delta_t$ (Av$\Delta_p/\Delta_t$) (steps 220 and 222), the Average Load Reaction Time (Av LRT) steps 224 and 226), and the total effective starting horsepower (ESH) (step 228) of this group of compressors. With these values, the controller can calculate the system reaction pressure critical (RPC) from the following formulas:

RTC=Av LRT+(ESH * 3 seconds / MSH)=Reaction Time Critical in seconds (Step 230)

MFP=Av$\Delta_p/\Delta_t$ * GQ=Maximum Falling Pressure in PSI./second (Step 232)

RPC=LSP+(RTC * MFP) (Step 234)

The reaction pressure critical (RPC) must be recalculated anytime the system is recalibrated, a compressor is added or the priority of any compressor is changed.

Compressor Start Constraints

In both the set sequence and CACES control modes of operation, there are certain restraints imposed upon the controller 10 when the controller attempts to start certain selected compressors. For example, if the service input of a compressor is closed to indicate that the compressor is under service, this compressor should not be started or loaded automatically.

Also, during the program mode, a maximum starting horsepower (MSH) value was entered in accordance with the capacity of the plant power distribution system. At the beginning of any CACES control period, the controller 10 must set the Available Starting Horsepower, ASH, equal to MSH. When a compressor is about to be started, the controller compares the compressor's effective starting horsepower (ESH) to the ASH. If the ESH<=ASH, the compressor is started and the ESH of this started compressor is then subtracted from the ASH so that the ASH available while this compressor starts is ASH-ESH. The controller includes a start timer for individual compressors which indicates when a compressor can be considered to be at full load speed. The individual start timer of the compressor is started at the same time the compressor is started, and when the start timer exceeds a specific time, i.e. 3 seconds, the ESH of the started compressor is added back into the ASH.

When a compressor to be started has an ESH greater than the present available ASH, the controller must wait until the ASH=MSH OR ASH=>ESH of the compressor to be started.

When a group of compressors have been chosen to be started, the controller will start the largest actual horsepower compressors within a given priority first. The controller will look at the largest actual horsepower compressor in the lowest number priority and, if its ESH<=ASH, the controller puts that compressor into the startup group and subtracts its ESH from the ASH. The controller then looks at the next largest actual horsepower compressor to see if its ESH plus the ESH of the first compressor is less than or equal to the ASH. If so, the controller adds this compressor to the startup group also. A group of compressors could be selected that would cross several priority lines, but the startup routine must not start a compressor of a higher priority number until all of the compressors with a lower priority number have been started.

The controller works from the largest actual horsepower compressor to the smallest within a priority class. If a compressor's ESH<=ASH, the compressor is put into the startup group and its ESH is subtracted from the ASH. The controller continues this selection method until ASH<=0 or until all of the compressors within the priority have been considered. At this point the controller starts all of the selected group compressors simultaneously and when the compressor timers exceed 3 seconds, the controller adds each compressor ESH back into the ASH. If there are still more compressors to start, the controller selects them in the same manner as before.

When the MSH entered during the program mode is, for example, 150, the controller could immediately start a compressor with an ESH of 50. If another compressor is selected one second later and its ESH<=100, the controller can also start it immediately. However, if the second compressor had an ESH of 75, then the controller can still start one compressor with an ESH<=25, before the start timer of the first compressor exceeds 3 seconds.

This startup sequence gets the maximum amount of horsepower started in the minimum amount of time while still providing startup protection for the plant power distribution system.

Pressure Transducer

The controller 10 of the present invention may, as previously indicated, be made responsive to a plurality of pressure transducers in the distribution system 4, but a major advantage of this invention resides in the fact that the total multiple compressor group $P_1$–$P_n$ may be controlled by a single transducer 14. The controller 10 is adapted to operate effectively with the transducer 14, and ideally, the controller interface 34 will provide pressure readings from this transducer every few milliseconds. To obtain a continuously updated $\Delta_p/\Delta_t$, the controller will continously average a group of ten to twenty pressure readings for the transducer 14. With each new reading, the controller will drop the oldest reading from the group and provide a new average from a group including the new reading. This new average is compared to the next previous average to calculate a $\Delta_p/\Delta_t$. The resultant rolling average method removes the effects of spurious pulsations in the pressure distribution system and yields a timely and accurate pressure and $\Delta_p/\Delta_t$.

Figure 8:
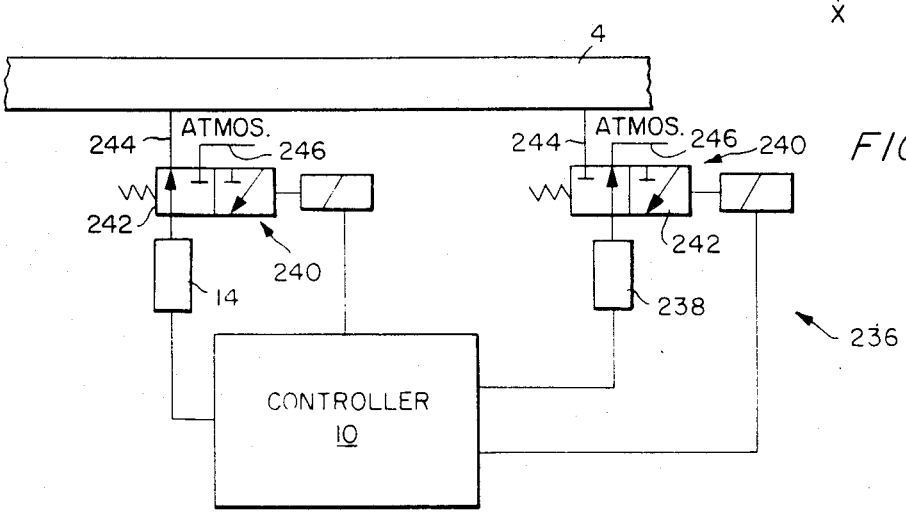
FIG. 8 illustrates a multiple pressure sensor and control for use with the system of FIG. 1.
Figure 5:
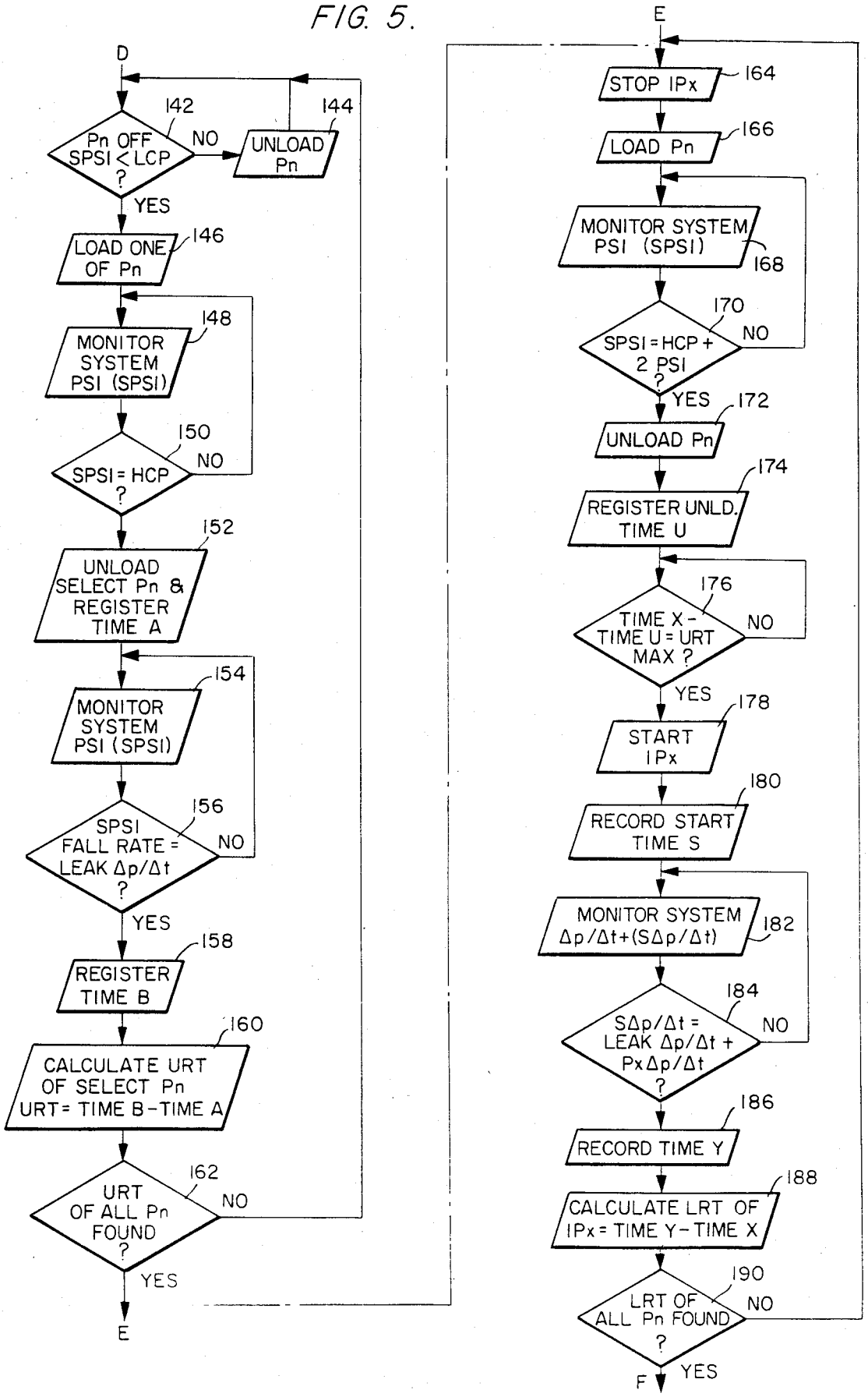

When only a single pressure transducer 14 is employed with the controller 10, it is advantageous to incorporate the transducer system 236 of FIG. 8. In this system, the primary transducer 14 is included in a unit with a secondary or backup transducer 238. Both the primary and the secondary transducers are selectively connected to either the distribution system 4 or are vented to atmosphere by a solenoid operated valve 240 contained in a housing 242 having one port 244 connected to the distribution system and one port 246 which opens to the atmosphere. The valve 240 may be operated by signals from the controller through the interface 34 to connect the primary and secondary transducers to either system pressure or atmosphere.

During normal operation, the primary transducer 14 is subject to distribution system pressure while the secondary transducer 238 is vented to atmosphere. However, during a control mode of operation, when the controller 10 has unloaded or loaded all of the compressors and the system pressure continues to rise or fall, respectively, even after the unloaded or loaded reaction time delays have timed out, it is advantageous for the controller to institute a transducer check routine. Also if the system pressure ever unexpectedly or suddenly exceeds 150 psi or falls below 20 psi during a control period, the controller should check the transducer. Finally, if the system demand should suddenly increase or decrease at a $\Delta_p/\Delta_t$ of twice the total $\Delta_p/\Delta_t$ of all the compressors, the controller should check the transducer.

When the controller first enters a transducer check routine, it must determine if a secondary transducer 238 has been provided or is still on standby. For example, even when a secondary transducer is included in the system, the controller may find that it is already using the secondary check transducer in place of the primary transducer because the primary transducer is bad.

If only one of the transudcers is present or operative, the controller will institute a single transducer check routine by energizing the solenoid valve 240 for this transducer. The solenoid valve is a three way solenoid valve that, when energized, removes system pressure from the transducer and applies atmospheric pressure. The single transducer check routine must occur quickly so that control action is not abandoned for long. If the controller can take pressure readings at a rate of 1/millisecond and average the readings over 8 milliseconds, then the controller should detect a pressure drop within ⅛th of a second. At the end of a sufficient period of time, the controller de-energizes the solenoid valve which then reapplies the system pressure to the transducer. Within a short period, the transducer should be indicating a substantial pressure rise. If the single transducer indicates a falling and rising pressure as it should, the controller returns to a normal control. If the single transducer does not indicate a fall and a rise in pressure, then the controller must stop all operative control modes until the transducer is repaired.

Ideally, the controller will find an operational secondary transducer that currently is not being used for control. The controller auto-zeroes this transducer before de-energizing its normally energized solenoid valve to apply system pressure to the secondary transducer. The controller then takes alternate readings between the primary and secondary transducers.

The controller must first determine if the primary transducer is relatively following the rise and fall of system pressure indicated by the secondary transducer. If not, the controller performs a quick single transducer check of the secondary transducer, and if the secondary transducer passes, the controller must assume that a bad primary transducer exists. If the secondary transducer does not pass the single transducer test, the controller must assume a bad secondary transducer, and then perform a single transducer check on the primary transducer. If both transducers fail to pass the single transducer check, the controller will provide a transducer fault alarm indication. If the primary and secondary transducers seem to follow each other, then the controller should determine if the deviation between the two transducers is less than 5%. If it is less than 5%, the controller assumes good transducers and returns to the control mode.

If the primary transducer output does not correspond to the secondary transducer output, the controller should energize the primary transducer solenoid valve and temporairly return to normal control using the secondary transducer for a predetermined period, i.e. 5 minutes. This allows the primary transducer to adequately bleed down to atmospheric pressure. At the end of the predetermined period, the controller auto-zeroes the primary transducer and de-energizes the solenoid valve therefor in order to re-apply system pressure.

At the end of each predetermined time period, the controller again determines if the deviation between the outputs of the primary and secondary transducers has been reduced to less than 5%. If so, the controller returns to normal control. If the outputs still do not agree, the controller assumes that a bad primary transducer exists.

The primary and secondary transducers may be autozeroed by energizing the respective solenoid valves therefor to apply atmospheric pressure. A significant delay, i.e. one to five minutes, should occur between applying atomspheric pressure and autooccur zeroing the transducer just to make sure that all of the system pressure has bled off.

Additional Control Functions

The versatility of the compressor controller of the present invention combined with the novel method of achieving compressor control in response to system pressure and leakage and the reaction time of individual compressors not only provides enhanced system pressure control, but also makes it feasible to immediately alter the programmed control parameters in response to sensed variations in system condition. For example, as illustrated in FIG. 1, a KW electrical demand controller 250 which, in FIG. 2, would be connected to the interface 34, could be used to cause the controller 10 to decrease the programmed target pressure for the system. When the compressor controller receives a signal from the demand controller 250, the compressor controller will lower the target pressure by a predetermined amount. This lowered target pressure would usually mean that fewer compressors will be running to maintain the target pressure.

Similarly, the controller 10 can be caused to raise the programmed target pressure in response to a received signal at the interface 34 from a remote low pressure switch 252. This switch would normally be placed near an air pressure critical application, and when the air pressure drops below a predetermined level, the switch 252 will close and send a signal to the controller 10. Upon receipt of this signal, the controller will increase the target pressure for the system, such increase normally requiring more compressors to be started.

Finally, the controller 10 may be made responsive to operation of the on line compressors at less than full load. To accomplish this, sensors 256 (one shown in FIG. 1) may be connected to each of the compressors $P_1$–$P_n$. By sensing the compressor's intake vacuum or modulating pressure, these sensors 256 can determine when a compressor is operating at some point less than full load. For example, if the sensor 256 senses the compressor's modulating pressure, the controller can be programmed to unload the smallest loaded compressor if a compressor is modulating for longer than a predetermined time period. This will force the remaining compressors to return toward full load operation.

Industrial Applicability

The multi-compressor control method and apparatus of the present invention enable the variously- 0 sized compressors of a multiple unit system to be loaded and unloaded in accordance with any one of several loading sequences. These sequences, including fixed and selective loading sequences, can be implemented as desired using a controller which has stored control data which has been provided both manually and directly from the system supplied by the compressors. Depending upon which loading sequence is implemented at a given time, compressor run time can be more evenly distributed among all of the compressors in the distribution system and compressor operating efficiency can be maximized by selecting groups of compressors having full load output capacities more closely matching the distribution system fluid demand. Thus, the method of the present invention provides a means for optimally governing the fluid distribution process, and can be advantageously applied to a variety of distribution systems such as industrial air supply systems.

We claim:

1. A method for controlling the selective loading and unloading of a plurality of fluid pumps connected for fluid input to a fluid distribution system to maintain system pressure of a desired level, said method including the steps of:

(a) determining the total volume of the fluid distribution system;

(b) determining the rate of fluid leakage from the fluid distribution system;

(c) determining the effect of the output capacity of each fluid pump on the fluid distribution system;

(d) measuring any variation in demand on the fluid distribution system;

(e) employing said total volume and/or said rate of fluid leakage to ascertain the amount of change in fluid input to the fluid distribution system required to match said variation in demand;

(f) selecting one or more fluid pumps having a combined output capacity at least equal to said amount of change in fluid input to the distribution system required to match said variation in demand; and (g) loading or unloading said one or more fluid pumps to provide said change in fluid input to the distributution system.

2. A method as set forth in claim 1, wherein said step of selecting one or more fluid pumps further includes the steps of maximizing pump operating efficiency by selecting only those fluid pumps having a combined full load output capacity substantially equal to said amount of change in fluid input to the fluid distribution system required to match said variation in demand.

3. A method as set forth in claim 1, wherein said step of measuring said variation in demand further includes the step of measuring the rate of change in the fluid distribution system pressure.

4. The method as set forth in claim 3, further including the step of measuring said rate of change in the fluid distribution system pressure at a single location in the fluid distribution system.

5. The method as set forth in claim 1 wherein said step of selecting one or more fluid pumps further includes the step of maximizing pump operating efficiency by first selecting available fluid pumps having a smaller capacity than the remaining pumps to be loaded when the variation in demand requires the loading of additional pumps and by first selecting loaded fluid pumps having a smaller capacity than the remaining pumps to be unloaded when the variation in demand requires the unloading of additional pumps.

6. The method as set forth in claim 1 wherein the step of selecting one or more fluid pumps further includes the step of protecting the pump power supply system by determining the number of pumps to be started and loaded when the variation in demand requires the loading of additional pumps, and sequentially starting said pumps in selected groups of one or more, the total starting power required by each such group being within the limits available from the pump power supply system.

7. A method for obtaining control data from a multiple compressor distribution system using the system compressors which includes a. establishing a predetermined calibration psi range for each of said system compressors, b. loading one or more of said system compressors to raise the system pressure while monitoring said system pressure, c. unloading said one or more compressors when the system pressure exceeds the upper level of said calibration psi range to cause said system pressure to fall, and d. timing the period required for said system pressure to fall through said calibration psi range to obtain a system leakage value.

8. The method of claim 7 which includes dividing the number of psi in said calibration psi range by the time required for said system pressure to fall through said calibration psi range to obtain the system leakage $\Delta p/\Delta t$.

9. The method of claim 8 which includes loading a plurality of compressors to again raise the system pressure to a point which exceeds the upper level of said calibration psi range after said system leakage $\Delta p/\Delta t$ is obtained, unloading all but one of said plurality of compressors when the system pressure exceeds the upper level of said calibration psi range to cause the system pressure to fall, timing the period required for the system pressure to fall through said calibration psi range to obtain a fall time with one loaded compressor, dividing the number of psi in the calibration psi range by said fall time to obtain a value indicative of the system leakage $\Delta p/\Delta t$ plus the loaded compressor $\Delta p/\Delta t$, and subtracting the system leakage $\Delta p/66$ t from the value indicative of the loaded compressor $\Delta p/\Delta t$ plus the system leakage $\Delta p/\Delta t$ to obtain the $\Delta p/\Delta t$ of said loaded compressor.

10. The method of claim 8 which includes determining a compressor unloaded reaction time after obtaining said system leakage $\Delta p/\Delta t$ by loading a single compressor to again raise the system pressure to the upper level of said calibration psi range, unloading said single compressor at said upper level and timing the period required for the system pressure to attain a fall rate equal to the system leakage $\Delta p/\Delta t$, said period being the unloaded reaction time of said single compressor.

11. The method of claim 8 which includes determining a compressor unloaded reaction time after obtaining said system leakage $\Delta p/\Delta t$ by loading a plurality of compressors to again raise the system pressure to a point which exceeds the upper level of said calibration psi range, unloading all compressors except a single loaded test compressor, unloading the test compressor when the system pressure falls to the upper level of the calibration psi range, and timing the period required for the system pressure to attain a fall rate equal to the system leakage $\Delta p/\Delta t$, said period being the unloaded reaction time of said test compressor.

12. The method of claim 7 which includes loading a single compressor to raise the system pressure, timing the period required for the system pressure to rise through said calibration psi range to obtain a value indicative of system leakage $\Delta p/\Delta t$ plus the $\Delta p/\Delta t$ of said compressor.

13. The method of claim 12 wherein said value indicative of system leakage $\Delta p/\Delta t$ plus the $\Delta p/\Delta t$ of said compressor is obtained by dividing the number of psi or said calibration psi range by the time required for said system pressure to rise through said calibration psi range.

14. The method of claim 12 which includes obtaining the $\Delta p/\Delta t$ of said single compressor by subtracting said system leakage value from said value indicative of system leakage $\Delta p/\Delta t$ plus the $\Delta p/\Delta t$ of said compressor.

15. The method of claim 14 which includes sequentially determining the unloaded reaction time for each of said system compressors after obtaining said system leakage $\Delta p/\Delta t$ by building the system pressure to at least the upper level of said calibration psi range for each compressor, under test, initiating a system pressure decrease at said upper level with all remaining system compressors unloaded by unloading said compressor under test, and timing the period required for the system pressure to attaina fall rate equal to the system leakage $\Delta p/\Delta t$, the extent of said period being the unloaded reaction time of the compressor under test.

16. The method of claim 15 which includes determining a compressor loaded reaction time after obtaining the unloaded reaction time for each of said system compressors by completely stopping a single compressor, loading one or more of the remaining system compressors to raise the system pressure above the upper limit of said calibration psi range, unloading all of the loaded compressors, permitting the system pressure to drop for a period equal to the greatest unloaded reaction time previously determined, starting said single stopped compressor upon the expiration of said greatest unloaded reaction time, and timing the period expiring from the starting of said single compressor to a point where the system $\Delta p/\Delta t$ has increased above the system leakage $\Delta p/\Delta t$ by the $\Delta p/\Delta t$ of the single compressor.

17. A method for obtaining control data from a multiple compressor distribution system using the system compressors which includes a. establishing a predetermined calibration psi range for each of said system compressors, and
b. sequentially loading and unloading system compressors and monitoring the rise and fall of system pressure within said calibration psi range and time of such rise and fall within said calibration psi range to obtain system leakage and individual system compressor data.

18. The method of claim 17 which includes the step of obtaining system volume from said system leakage and individual system compressor data.

19. The method of claim 17 wherein said system leakage data is the system leakage $\Delta p/\Delta t$ and said individual system compressor data includes the compressor $\Delta p/\Delta t$.

20. A method for obtaining control data from a multiple compressor distribution system using the system compressors which includes a. establishing a predetermined calibration psi range for each of said system compressors, and
b. sequentially loading and unloading system compressors and monitoring the rise and fall of system pressure within said calibration psi range to obtain system leakage and individual system compressor data, said system leakage data being the system leakage $\Delta p/\Delta t$ and said individual system compressor data including the compressor $\Delta p/\Delta t$ and the compressor loaded and unloaded reaction times.

21. The method of claim 20 which includes the step of obtaining a reaction pressure critical point using said loaded reaction times and compressor $\Delta p/\Delta t$ values, said reaction pressure critical point being a point where additional system compressors should be started to prevent system pressure from falling below a preset low pressure point.

22. A multiple compressor and control system connected to a fluid distribution system so as to maintain system pressure at a desired level comprising:

a. transducer means positioned in said distribution system to sense the system pressure and provide an electrical output signal indicative of said system pressure,
b. a plurality of compressors connected to said fluid distribution system,
c. a plurality of compressor control means connected to said compressors to start, load unload and stop said compressors, each such compressor being connected to one of said control means, and
d. a central multiple compressor controller connected to said compressor control means and to said transducer means, said multiple compressor controller including
   (1) electronic data generating means connected to both said transducer means and said compressor control means and operative to provide electrical data signals indicative of compressor condition and system pressure;
   (2) data storage means for receiving said electrical data signals from said electronic data generating means, said electronic data generating means including a data input means for permitting the manual input of control data, compressor data and system data into said data storage means and a clock means for inputting timing data into said data storage means, and
   (3) system controller means to provide control signals to said compressor control means.

23. The multiple compressor and control system of claim 22 wherein said transducer means includes a single pressure sensing transducer.

24. A multiple compressor and control system connected to a fluid distribution system so as to maintain system pressure at a desired level comprising:

a. transducer means positioned in said distribution system to sense the system pressure and provide an electrical output signal indicative of said system pressure, said transducer means including
   a primary pressure transducer and a secondary pressure transducer, and electronic valve means for selectively connecting said primary transducer and said secondary transducer to either said distribution system or to atmosphere,
b. a plurality of compressors connected to said fluid distribution system,
c. a plurality of compressor control means connected to said compressors to start, load unload and stop said compressors, each such compressor being connected to one of said control means, and
d. a central multiple compressor controller connected to said compressor control means and to said transducer means, said multiple compressor controller including (1) electronic data generating means connected to both said transducer means and said compressor control means and operative to provide electrical data signals indicative of compressor condition and system pressure;

(2) data storage means for receiving said electrical data signals from said electronic data generating means, and (3) system controller means to provide control signals to said compressor control means.

25. A method for controlling the selective loading and unloading of a plurality of fluid pumps connected for fluid input to a fluid distribution system to maintain system pressure of a desired level which includes a. obtaining the load and unload reaction time for each of said system fluid pumps;

b. setting a desired pressure range at which said system pressure is to be maintained;

c. bringing said system pressure to within said desired pressure range;

d. measuring any variation of system pressure in said fluid distribution system;

e. selecting one or more fluid pumps having a combined output capacity sufficient to offset said variation of fluid pressure; and f. loading or unloading said selected fluid pumps in accordance with the load or unload reaction times thereof to offset any variation in the fluid pressure of the fluid distribution system before the system pressure varies beyond said desired pressure range.

26. A method as set forth in claim 25 wherein said step of measuring any variation of system pressure includes the step of measuring the rate of change of system pressure, said step of loading or unloading one or more selected fluid pumps being accomplished in accordance with the load or unload reaction times of said selected fluid pumps and the time required for said system pressure to vary beyond said desired pressure range.

27. A method as set forth in claim 25 which includes obtaining the output capacity of each fluid pump in the fluid distribution system for use in selecting said one or more fluid pumps.

28. A method as set forth in claim 27 which includes obtaining the rate of fluid leakage from the fluid distribution system, said step of obtaining the output capacity of each fluid pump including using said system fluid leakage to determine the actual effect of the output capacity of each fluid pump on said fluid distribution system pressure and using said actual effect in the selection of said selected fluid pumps.

* * * * *